US008454350B2

(12) United States Patent
Berry et al.

(10) Patent No.: US 8,454,350 B2
(45) Date of Patent: Jun. 4, 2013

(54) DILUENT SHROUD FOR COMBUSTOR

(75) Inventors: Jonathan Dwight Berry, Simpsonville, SC (US); John Joseph Lipinski, Simpsonville, SC (US); Girard Albert Simons, Anderson, SC (US); Abhijit Som, Greer, SC (US)

(73) Assignee: General Electric Company, Schenectady, NY (US)

( * ) Notice: Subject to any disclaimer, the term of this patent is extended or adjusted under 35 U.S.C. 154(b) by 480 days.

(21) Appl. No.: 12/260,545

(22) Filed: Oct. 29, 2008

(65) Prior Publication Data

US 2010/0101204 A1 Apr. 29, 2010

(51) Int. Cl.
*F23C 5/00* (2006.01)

(52) U.S. Cl.
USPC ..... 431/8; 431/354; 431/12; 431/10; 431/187; 431/115; 60/749; 60/760; 239/544; 239/466

(58) Field of Classification Search
USPC ..... 431/8, 354, 12, 10, 187, 115; 60/749, 60/760; 239/544, 466
See application file for complete search history.

(56) References Cited

U.S. PATENT DOCUMENTS 3,693,347 A 9/1972 Kydd et al.
3,785,146 A 1/1974 Bailey et al.
3,874,592 A * 4/1975 Buschmann et al. ..... 239/132.3
4,522,024 A 6/1985 Zaugg
5,092,760 A * 3/1992 Brown et al. ..... 431/10
5,284,438 A * 2/1994 McGill et al. ..... 431/9
5,722,821 A * 3/1998 Christenson ..... 431/10
5,983,622 A 11/1999 Newburry et al.
6,370,862 B1 4/2002 Cheng
6,374,615 B1 * 4/2002 Zupanc et al. ..... 60/748
6,883,329 B1 * 4/2005 Martling ..... 60/746
2002/0090587 A1 * 7/2002 Pribish ..... 431/160
2006/0127827 A1 * 6/2006 Yoshida et al. ..... 431/8
2010/0170253 A1 * 7/2010 Berry et al. ..... 60/742
2010/0281869 A1 * 11/2010 Hadley et al. ..... 60/734
2010/0281871 A1 * 11/2010 Hadley et al. ..... 60/737
2010/0281872 A1 * 11/2010 Hadley et al. ..... 60/748
2012/0204571 A1 * 8/2012 Kraemer et al. ..... 60/776
2012/0282558 A1 * 11/2012 Kraemer et al. ..... 431/9

* cited by examiner

*Primary Examiner* — Avinash Savani
(74) *Attorney, Agent, or Firm* — Cantor Colburn LLP

(57) ABSTRACT

Disclosed is a combustor including a baffle plate having at least one through baffle hole and at least one fuel nozzle extending through the at least one through baffle hole. At least one diluent shroud is affixed to the at least one baffle plate and is configured to guide a diluent flow toward a mixing chamber of the at least one fuel nozzle. Further disclosed is a method for introducing a diluent flow into a mixing chamber of a fuel nozzle including urging the diluent flow from a plenum through a baffle plate gap between a baffle plate and an outer surface of the fuel nozzle. The diluent flow is directed via at least one diluent shroud extending from the baffle plate toward a plurality of air swirler holes extending through a fuel nozzle tip. The diluent flow is flowed through the plurality of air swirler holes into the mixing chamber.

16 Claims, 4 Drawing Sheets

DILUENT SHROUD FOR COMBUSTOR

BACKGROUND OF THE INVENTION

The subject invention relates generally to combustors. More particularly, the subject invention relates to the introduction of diluent flow into a combustor.

Combustors typically include one or more fuel nozzles that introduce a fuel or a mixture of fuel and air to a combustion chamber where it is ignited. In some combustors, the fuel nozzles extend through holes disposed in a baffle plate of the combustor. In these combustors, it is often advantageous to introduce a volume of diluent, often nitrogen or steam, to the combustor to reduce $NO_x$ and/or CO emissions and/or augment output of the combustor. The diluent is urged from a chamber through a gap between the baffle plate and each fuel nozzle then flows along a periphery of the fuel nozzle where a portion of the diluent enters a plurality of air swirler holes and is mixed with air and introduced into the fuel nozzle. Under some conditions, however, the diluent is drawn toward a center hub of the combustor, away from the plurality of air swirler holes, by, for example, a region of low pressure near the center hub. When the diluent is drawn toward the center hub, the diluent effectiveness is reduced and may cause operability problems in the combustor such as blow out.

BRIEF DESCRIPTION OF THE INVENTION

According to one aspect of the invention, a combustor includes at least one baffle plate including at least one through baffle hole and at least one fuel nozzle extending through the at least one through baffle hole. At least one diluent shroud is affixed to the at least one baffle plate and is configured to guide a diluent flow toward a mixing chamber of the at least one fuel nozzle.

According to another aspect of the invention, a method for introducing a diluent flow into a mixing chamber of a fuel nozzle includes urging the diluent flow from a plenum through a baffle plate gap between a baffle plate and an outer surface of the fuel nozzle. The diluent flow is directed via at least one diluent shroud extending from the baffle plate toward a plurality of air swirler holes extending through a fuel nozzle tip. The diluent flow is flowed through the plurality of air swirler holes into the mixing chamber.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
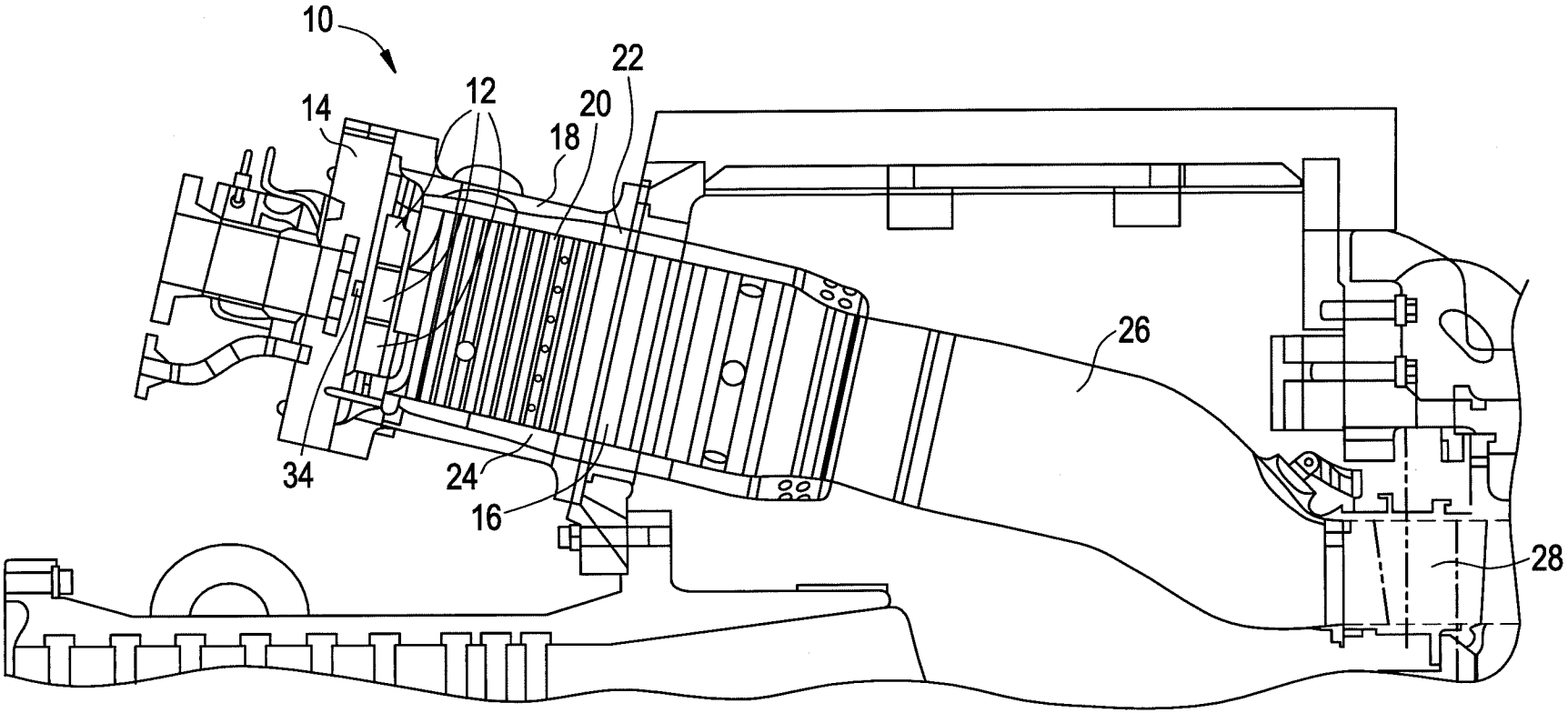
FIG. 1 is an cross-sectional view of an embodiment of a combustor.

Shown in FIG. 1 is an embodiment of a combustor 10. The combustor 10 includes a plurality of fuel nozzles 12 disposed at an end cover 14. Compressed air and fuel are directed through the end cover 14 to the plurality of fuel nozzles 12, which distribute a mixture of the compressed air and the fuel into the combustor 10. The combustor 10 includes a combustion chamber 16 generally defined by a casing 18, a liner 20 and a flow sleeve 22. In some embodiments, the flow sleeve 22 and the liner 20 are substantially coaxial to define an annular air passage 24 that may enable passage of an airflow therethrough for cooling and/or entry into the combustion chamber 16 via, for example a plurality of perforations (not shown) in the liner 20. The casing 18, the liner 20 and the flow sleeve 22 are configured to provide a desired flow of the mixture through a transition piece 26 toward a turbine 28.

Figure 2:
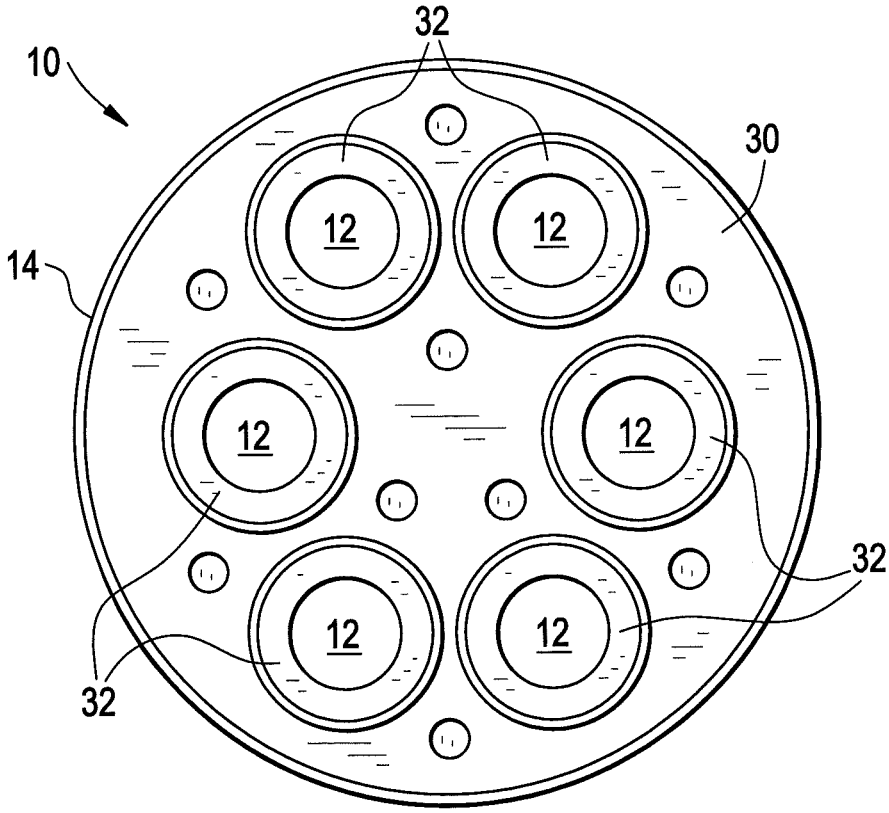
FIG. 2 is an end view of the combustor of FIG. 1.
Figure 3:
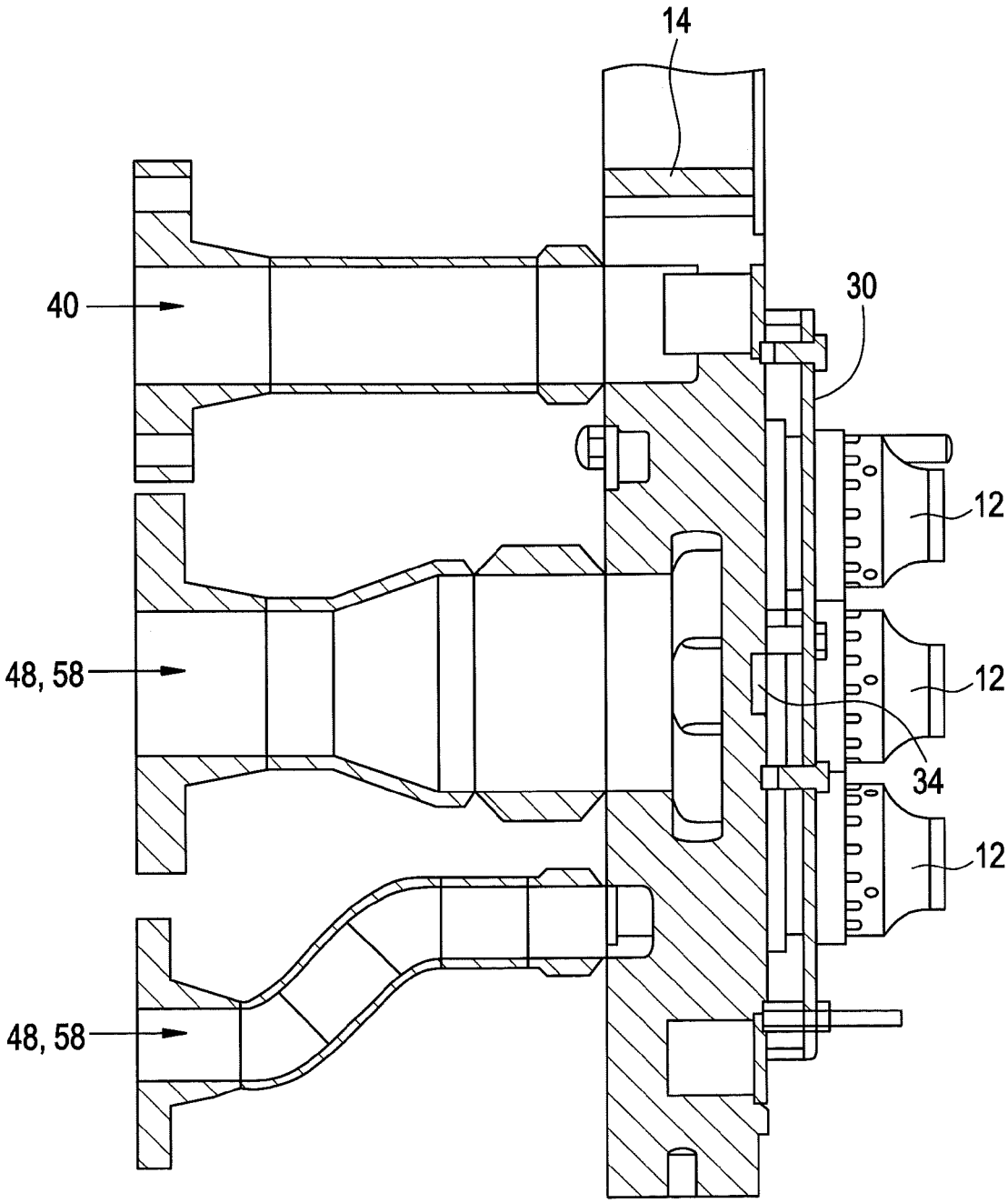
FIG. 3 is a cross-sectional view of an embodiment of an endcover of the combustor of FIG. 1.
Figure 4:
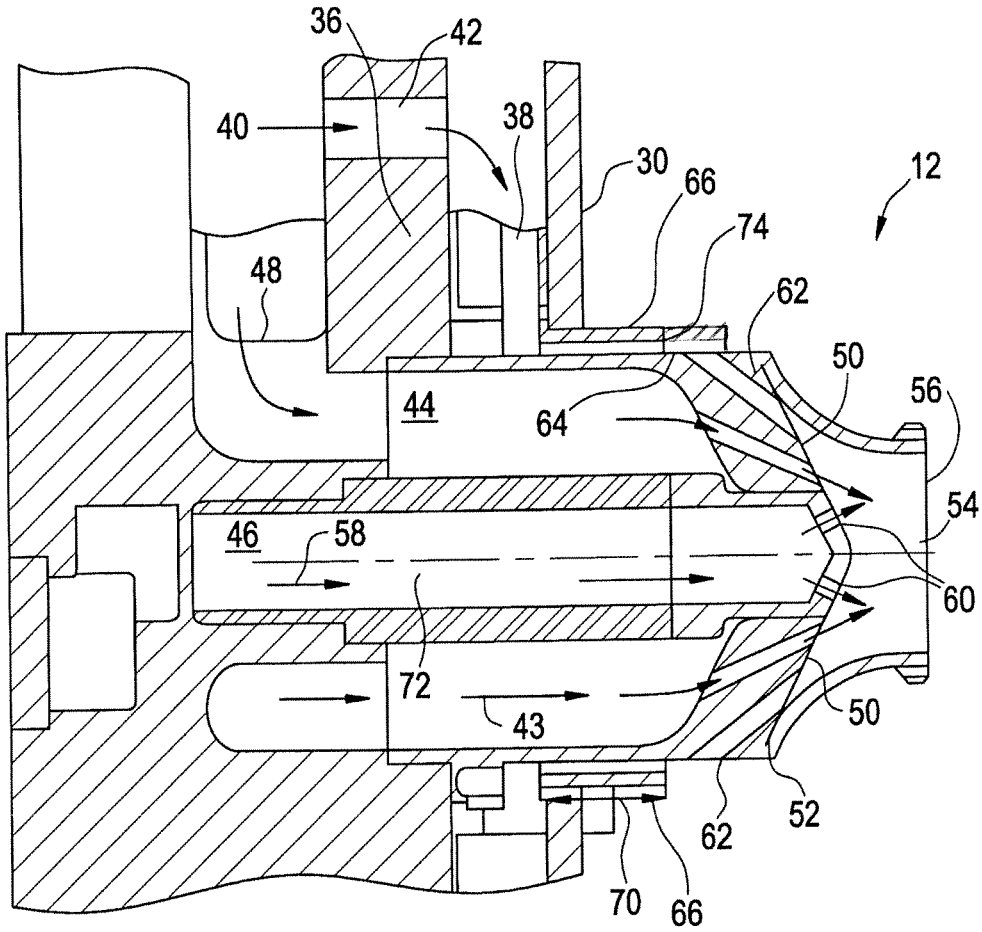
FIG. 4 is a partial cross-sectional view of a fuel nozzle of an embodiment of a combustor.

Referring now to FIG. 2, the combustor 10 includes a baffle plate 30 having six baffle holes 32, through which six fuel nozzles 12 extend, for example, one fuel nozzle 12 extending through each baffle hole 32. While six fuel nozzles 12 are shown in FIG. 2, it is to be appreciated that other quantities of fuel nozzles 12, for example, one or four fuel nozzles 12, may be utilized. The fuel nozzles 12 are arranged around a center hub 34 of the combustor 10, as best shown in FIG. 3. Referring now to FIG. 4, the baffle plate 30 and a cover ring 36 define a plenum 38 into which a diluent flow 40 is guided via an array of orifices 42 in the cover ring 36. In some embodiments, the diluent flow 40 may comprise steam, or other diluents such as nitrogen.

As shown in FIG. 4, each fuel nozzle 12 includes at least one purge air chamber 44 and at least one fuel chamber 46. A purge air flow 48 is urged from the purge air chamber 44 through a plurality of purge air holes 50 extending through a nozzle tip 52 into a mixing chamber 54 disposed beneath a nozzle cap 56. Similarly, a fuel flow 58 is urged from the fuel chamber 46 through a plurality of fuel holes 60 extending through the nozzle tip 52 into the mixing chamber 54. Further, a plurality of air swirler holes 62 extend through the fuel nozzle 12 from an outer surface 64 of the fuel nozzle 12 to the nozzle tip 52. It is to be appreciated that, in some embodiments and/or under certain operating conditions, the purge air chamber 44 may be supplied with fuel flow 58 and/or the fuel chamber 46 may be supplied with purge air flow 48.

A diluent shroud 66 is disposed at each baffle hole 32 and located radially outboard of the outer surface 64 of fuel nozzle 12. The diluent shroud 66 extends along the outer surface 64 forward from the baffle plate 30 toward a cap end 68 of the combustor 10. The diluent shroud 66 may be affixed to the baffle plate 30 by, for example, welding, brazing, one or more mechanical fasteners, or other attachment means. Further, in some embodiments, the diluent shroud 66 may be secured to the baffle plate 30 by friction via, for example, a press fit or an interference fit. The diluent shroud 66 extends perimetrically around the fuel nozzle 12, and in some embodiments is substantially cylindrically shaped.

As the diluent flow 40 flows from the plenum 38 and through the baffle hole 32, the diluent shroud 66 guides the diluent flow 40 toward the plurality of air swirler holes 62. A desired portion of the diluent flow 40 flows through the plurality of air swirler holes 62 and into the mixing chamber 64 where the diluent flow 40 mixes with the purge air flow 48 and the fuel flow 58.

A length 70 of the diluent shroud 66 is sufficient to direct the desired portion of the diluent flow 40 toward the plurality of air swirler holes 62 and prevents the desired portion of the diluent flow 40 from flowing toward the center hub 34. In some embodiments, the diluent shroud 66 may extend beyond the plurality of air swirler holes 62 to further ensure the desired portion of the diluent flow 40 is directed toward the plurality of air swirler holes 62. Further, in some embodiments, the diluent shroud 66 is positioned such that it is substantially concentric with the fuel nozzle 12 about a fuel nozzle axis 72. Positioning the diluent shroud 66 concentric with the fuel nozzle 12 increases a uniformity of diluent flow 40 around a perimeter of the fuel nozzle 12. Further, a shroud gap 74 may be substantially equal at each fuel nozzle 12 in the combustor 10 to increase a uniformity of diluent flow 40 throughout the combustor 10.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A combustor comprising: a baffle plate including at least one through baffle hole; at least one fuel nozzle extending through the at least one through baffle hole, the at least one fuel nozzle including: a fuel nozzle tip through which a flow of fuel is introduced; and a fuel nozzle cap disposed downstream of the fuel nozzle tip, a mixing chamber defined by the fuel nozzle tip and the fuel nozzle cap; and at least one diluent shroud affixed to the baffle plate radially outboard of the at least one fuel nozzle, the at least one diluent shroud and the at least one fuel nozzle defining a channel therebetween disposed entirely axially upstream of the fuel nozzle tip and in fluid communication with the mixing chamber and configured to guide a diluent flow into the mixing chamber of the at least one fuel nozzle.

2. The combustor of claim 1 wherein the at least one fuel nozzle includes a plurality of air swirler holes extending from an outer surface of the at least one fuel nozzle through the fuel nozzle tip to the mixing chamber.

3. The combustor of claim 2 wherein the at least one diluent shroud is configured to guide the diluent flow toward the plurality of air swirler holes.

4. The combustor of claim 2 wherein a length of the at least one diluent shroud extends beyond the plurality of air swirler holes.

5. The combustor of claim 1 wherein the at least one diluent shroud is affixed to the at least one baffle plate by brazing, welding, and/or at least one mechanical fastener.

6. The combustor of claim 1 wherein the at least one diluent shroud is substantially concentric with the at least one fuel nozzle about a fuel nozzle axis.

7. The combustor of claim 1 wherein a gap between each fuel nozzle of the at least one fuel nozzles and a corresponding diluent shroud is substantially equal.

8. The combustor of claim 1 wherein the at least one fuel nozzle includes a plurality of purge air holes configured to direct purge air into the mixing chamber.

9. The combustor of claim 1 wherein the at least one fuel nozzle includes a plurality of fuel holes configured to direct fuel into the mixing chamber.

10. The combustor of claim 1 wherein the at least one fuel nozzle is six fuel nozzles.

11. The combustor of claim 10 wherein the six fuel nozzles are arrayed around a central combustor hub.

12. The combustor of claim 11 wherein the at least one shroud is configured to reduce the diluent flow directed toward the central combustor hub.

13. A method for introducing a diluent flow into a mixing chamber of a fuel nozzle of a combustor comprising: urging the diluent flow from a plenum through a baffle plate gap between a baffle plate and an outer surface of the fuel nozzle; directing the diluent flow via a diluent channel defined by at least one diluent shroud extending from the baffle plate and the outer surface of the fuel nozzle toward a plurality of air swirler holes extending through a fuel nozzle tip, the diluent channel disposed entirely axially upstream of the fuel nozzle tip; and flowing the diluent flow through the plurality of air swirler holes into a mixing chamber defined by the fuel nozzle tip and a fuel nozzle cap, the mixing chamber in fluid communication with the diluent channel and located downstream of the fuel nozzle tip, the fuel nozzle tip introducing a fuel flow into the mixing chamber.

14. The method of claim 13 including urging a purge air flow into the mixing chamber via a plurality of purge air flow holes in the fuel nozzle tip.

15. The method of claim 13 including urging a fuel flow into the mixing chamber via a plurality of fuel holes in the fuel nozzle tip.

16. The method of claim 13 including mixing the diluent flow with the fuel flow in the mixing chamber.

* * * * *